US009441353B1

(12) United States Patent
Hamil et al.

(10) Patent No.: US 9,441,353 B1
(45) Date of Patent: Sep. 13, 2016

(54) REINFORCED TOILET PLUNGER AND CASE

(71) Applicants: Shelia Hamil, Conyers, GA (US); Caulton Hamil, Conyers, GA (US)

(72) Inventors: Shelia Hamil, Conyers, GA (US); Caulton Hamil, Conyers, GA (US)

( * ) Notice: Subject to any disclaimer, the term of this patent is extended or adjusted under 35 U.S.C. 154(b) by 0 days.

(21) Appl. No.: 14/817,854

(22) Filed: Aug. 4, 2015

(51) Int. Cl.
*E03D 11/00* (2006.01)
*E03C 1/308* (2006.01)
*A47K 17/00* (2006.01)

(52) U.S. Cl.
CPC ..... *E03C 1/308* (2013.01); *A47K 17/00* (2013.01); *E03D 11/00* (2013.01)

(58) Field of Classification Search
CPC ..... E03C 1/308
USPC ..... 4/255.01–255.12
See application file for complete search history.

(56) References Cited

U.S. PATENT DOCUMENTS 5,305,882 A * 4/1994 Kaplan ..... A46B 5/0033 15/144.4
5,927,492 A * 7/1999 Moore ..... A47B 81/02 206/349
6,038,709 A * 3/2000 Kent ..... A47K 11/10 15/160
6,241,091 B1 * 6/2001 Moore ..... A47B 81/02 206/349
6,510,860 B2 * 1/2003 Kihs ..... E03C 1/308 134/166 C
D471,393 S * 3/2003 Hutchinson ..... E03C 1/308 D6/551
6,550,074 B1 * 4/2003 Allenbaugh ..... B08B 9/0321 4/255.01
6,729,470 B2 * 5/2004 Watlington ..... A47K 17/00 206/349
6,842,935 B2 * 1/2005 Peterson ..... A46B 17/06 134/135
7,299,519 B1 * 11/2007 Garry ..... A46B 7/023 15/104.05
7,430,779 B1 * 10/2008 Garry ..... A46B 7/023 15/104.05
7,841,029 B1 * 11/2010 Williams ..... A47K 17/00 4/661
8,065,754 B2 * 11/2011 Johnson ..... B08B 9/0436 4/255.01
D655,465 S * 3/2012 Raven ..... B25G 1/01 D32/14
8,127,402 B2 * 3/2012 Overgaard ..... B25G 1/01 15/143.1
8,209,790 B1 * 7/2012 Garry ..... A46B 7/023 4/255.11
8,684,022 B1 * 4/2014 McFarland ..... B08B 9/0436 137/15.07
D722,210 S * 2/2015 Gwen ..... B08B 9/0436 D32/14
9,015,890 B1 * 4/2015 Owens ..... B08B 9/027 15/104.33
9,217,245 B2 * 12/2015 Yu ..... B08B 9/045
2002/0100705 A1 * 8/2002 Phillips ..... A47K 11/10 206/349
2004/0003458 A1 * 1/2004 Nasco ..... E03C 1/308 4/255.11
2008/0073243 A1 * 3/2008 Rosh ..... A47K 10/22 206/581
2010/0313345 A1 * 12/2010 Stein ..... E03C 1/308 4/255.11
2013/0036542 A1 * 2/2013 Loughman ..... A47K 11/10 4/255.11

FOREIGN PATENT DOCUMENTS

CN 203188322 9/2013

* cited by examiner

*Primary Examiner* — Lori Baker

(57) ABSTRACT

The reinforced toilet plunger and case is a toilet plunger with an enhanced handle that screws into the top of the traditional toilet plunger handle. The enhanced handle allows the user to use a more practical and comfortable grip when using the reinforced toilet plunger and case. The reinforced toilet plunger and case further discloses a decorative canister in which the reinforced toilet plunger is stored. The decorative canister includes a door for access and a sanitary tray located in the bottom of the canister to absorb drippings from the plunger that may occur after use. The reinforced toilet plunger and case comprises a reinforced toilet plunger and a decorative canister.

12 Claims, 4 Drawing Sheets

REINFORCED TOILET PLUNGER AND CASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of plungers and water closets, more specifically, a reinforced toilet plunger.

SUMMARY OF INVENTION

The reinforced toilet plunger and case is a toilet plunger with an enhanced handle that screws into the top of the traditional toilet plunger handle. The enhanced handle allows the user to use a more practical and comfortable grip when using the reinforced toilet plunger and case. The reinforced toilet plunger and case further discloses a decorative canister in which the reinforced toilet plunger is stored. The decorative canister includes a door for access and a sanitary tray located in the bottom of the canister to absorb drippings from the plunger that may occur after use.

These together with additional objects, features and advantages of the reinforced toilet plunger and case will be readily apparent to those of ordinary skill in the art upon reading the following detailed description of the presently preferred, but nonetheless illustrative, embodiments when taken in conjunction with the accompanying drawings.

In this respect, before explaining the current embodiments of the reinforced toilet plunger and case in detail, it is to be understood that the reinforced toilet plunger and case is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the reinforced toilet plunger and case.

It is therefore important that the claims be regarded as including such equivalent construction insofar as they do not depart from the spirit and scope of the reinforced toilet plunger and case. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6. The reinforced toilet plunger and case 100 (hereinafter invention) comprises a reinforced toilet plunger 101 and a decorative canister 102.

Figure 1:
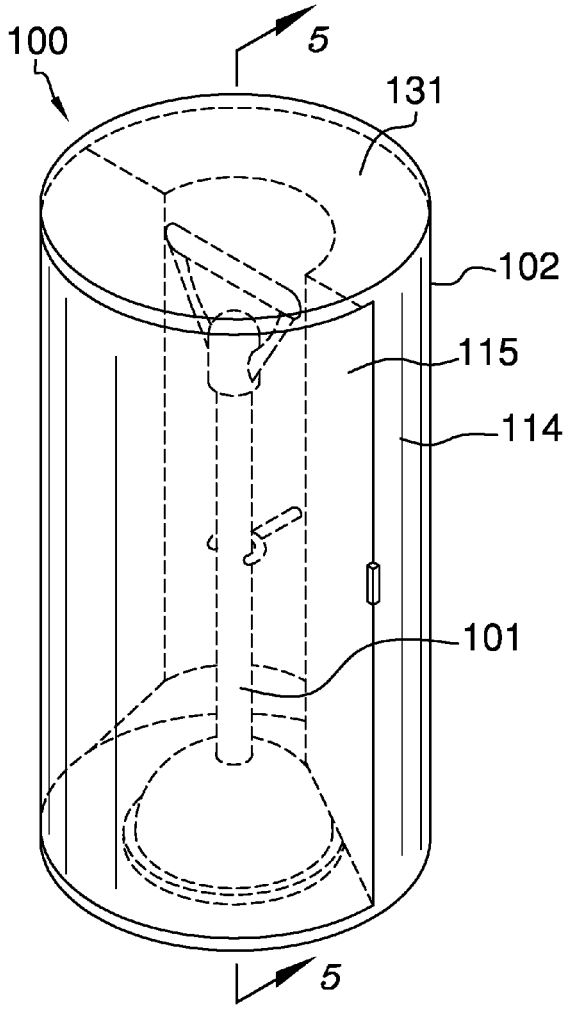
FIG. 1 is a perspective view of an embodiment of the disclosure.
Figure 2:
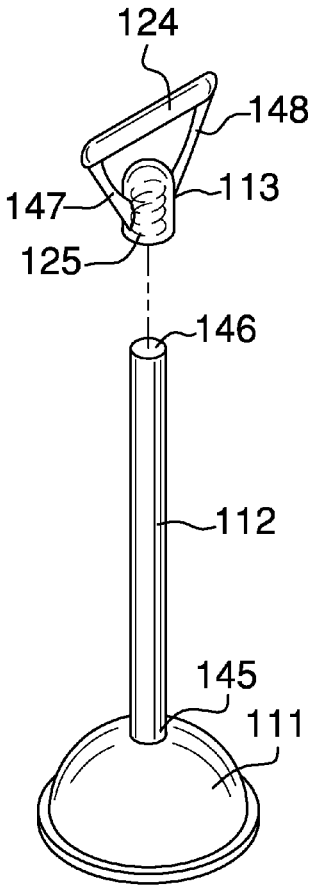
FIG. 2 is a detail view of an embodiment of the disclosure.
Figure 3:
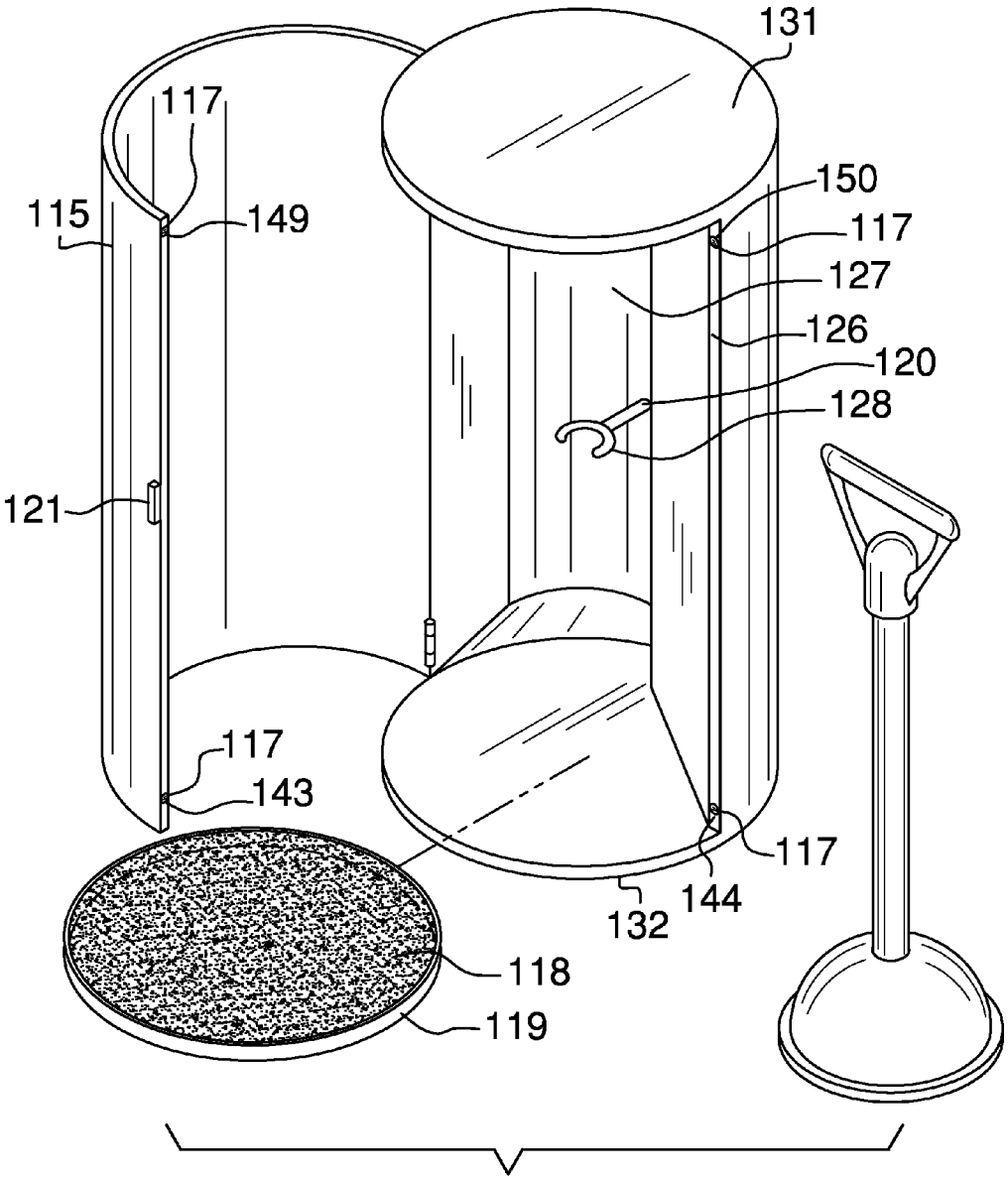
FIG. 3 is an exploded view of an embodiment of the disclosure.
Figure 4:
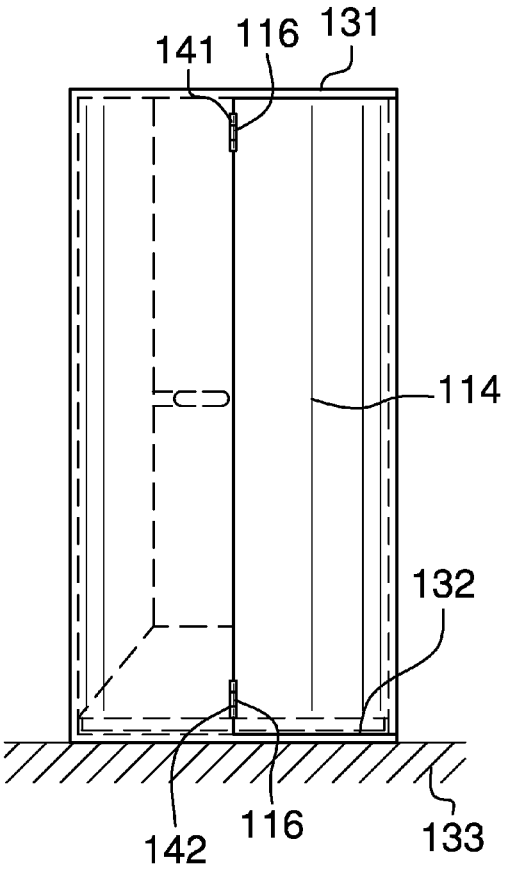
FIG. 4 is a side view of an embodiment of the disclosure.
Figure 5:
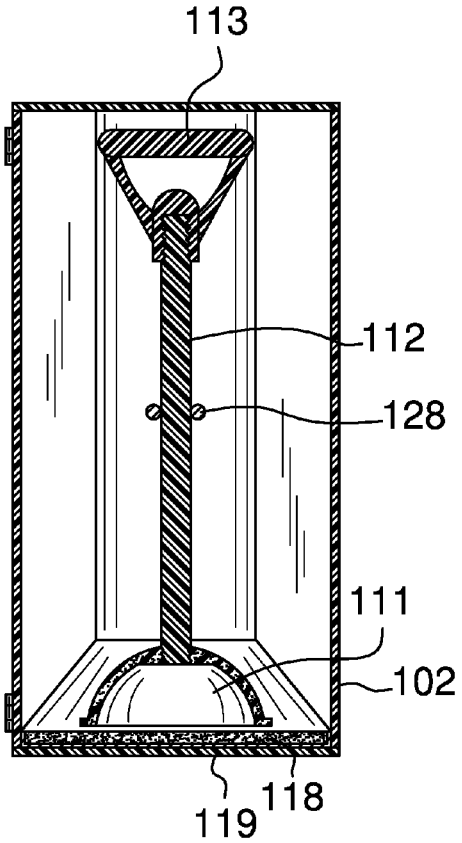
FIG. 5 is a cross-sectional view of an embodiment of the disclosure across line 5-5 in FIG. 1.
Figure 6:
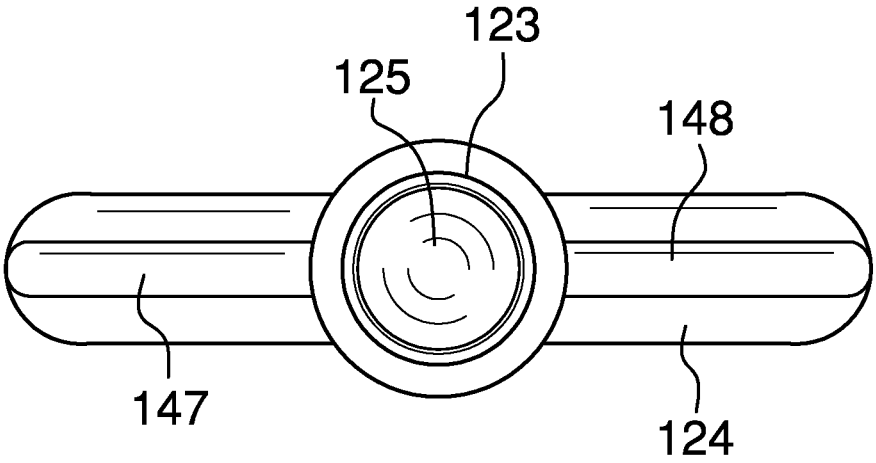
FIG. 6 is a detail view of an embodiment of the disclosure.

The reinforced toilet plunger 101 further comprises a force cup 111, a shaft 112, and a D Grip 113. The force cup 111 is a rubber suction cup. When the force cup 111 is compressed against the end of a blocked pipe and then pulled away from the clogged pipe, the force cup 111 creates a vacuum within the clogged pipe that helps to dislodge the material that is blocking the pipe. The shaft 112 is a cylindrical bar that is further defined with a fifth end 145 and a sixth end 146. The fifth end 145 of the shaft 112 is connected to the force cup 111. The D Grip 113 is a commercially available D Grip handle. The D Grip 113 further comprises a hand grip 124, a seventh reinforced Y arm 147, an eighth reinforced Y arm 148, and a connector 125. As shown in FIG. 2, the seventh reinforced Y arm 147 and the eighth reinforced Y arm 148 are used to attach the connector 125 to the hand grip 124. The connector 125 is formed with an interior screw thread 123, which may be a helicoil or other instrument capable of forming an external screw thread onto a rod-shaped object.

Once the shaft 112 is attached to the interior screw thread 123 of the D Grip 113, the reinforced toilet plunger 101 is ready for use. The interior screw thread 123 of the D Grip 113 is made of a material comprising a metal; whereas the shaft 112 is made of a wood. As the interior screw thread 123 is rotated onto the sixth end 146 of the shaft 112, the shaft 112 is cut in order to form a tight connection between the D grip 113 and the shaft 112.

The purpose of the shaft 112 and the D Grip 113 is to position the force cup 111 over the end of the clogged pipe. The positioning of the hand grip 124 of the D grip 113 perpendicular to the direction of the shaft 112 provides several advantages including, but not limited to: 1) better control the clogged pipe; and, 2) better leverage for the user to compress the force cup 111 over the open end of the clogged pipe and to pull the force cup 111 away thereby creating a vacuum.

The decorative canister 102 further comprises a shell 114, a door 115, a plurality of hinges 116, a plurality of magnets 117, a removable absorbent pad 118, a sanitary tray 119, a plunger clip 120, and a doorknob 121. The shell 114 is a cylindrically shaped hollow casing that is used to contain the reinforced toilet plunger 101. The two ends of the shell 114 are called the top end 131 and a bottom end 132. The bottom end 132 is a flat surface that rests on the ground 133. The top end 131 is the end of the shell 114 that is distal from the bottom end 132. The door 115 is a solid closure that is used to block access to the interior 127 of the shell 114 through the aperture 126. The door 115 is mounted onto the shell 114 using a plurality of hinges 116. The plurality of hinges 116 act as a pivot point around which the door 115 can be rotated. By rotating the door 115 away from the shell 114, access to the interior 127 of the shell 114 can be gained. When the door 115 is pressed against the shell 114, the door 115 is held in position by a plurality of magnets 117. A door knob 121 is mounted on the door 115. The door knob 121 is a handle that is used to rotate the door 115 towards or away from the shell 114.

Within the interior 127 of the shell 114 is placed the sanitary tray 119. The sanitary tray 119 is a tray that is designed to receive the removable absorbent pad 118. When the removable absorbent pad 118 needs to be changed, the sanitary tray 119 is removed from the interior 127 of the shell 114 to provide unfettered access to the removable absorbent pad 118.

The removable absorbent pad 118 is an absorbent material that is placed in the sanitary tray 119. The purpose of the removable absorbent pad 118 is to absorb drippings from the reinforced toilet plunger 101 after the reinforced toilet plunger 101 has been used.

The plunger clip 120 is a small U shaped clip 128 that is attached to an eleventh shaft 151. The eleventh shaft 151 is mounted in the interior 127 surface of the shell 114 so that the U shaped clip 128 is centered over the centerline of the shell 114. The purpose of the plunger clip 120 is to hold the shaft 112 of the reinforced toilet plunger 101 in position.

In the first potential embodiment of the disclosure, the plurality of hinges 116 further comprises a first hinge 141 and a second hinge 142. The plurality of magnets 117 further comprises a third magnet 143, a fourth magnet 144, a ninth magnet 149 and a tenth magnet 150. The fourth magnet 144 and the tenth magnet 150 are mounted on the shell 114. The third magnet 143 and the ninth magnet 149 are mounted on the door 115. When the door 115 is positioned to close the aperture 126, the magnetic attraction between the third magnet 143 and the fourth magnet 144 and magnetic attraction between the ninth magnet 149 and the tenth magnet 150 combine to hold the door 115 in position.

To use the invention 100, the door 115 is opened and the reinforced toilet plunger 101 is removed from the decorative canister 102. Placing one hand on the shaft 112 and one hand on the hand grip 124 of the D Grip 113, the user places the force cup 111 over the end of the clogged pipe. Using the leverage generated by the D Grip 113, the user pushes the force cup 111 into the end of the clogged pipe and then pulls the force cup 111 in the opposite direction. This movement generates a vacuum that breaks up the material blocking the clogged pipe. Once this material is cleared, the user places the reinforced toilet plunger 101 back into the decorative canister 102. After a period of time, the user returns to the decorative canister 102 and removes the reinforced toilet plunger 101, the sanitary tray 119 and replaces the removable absorbent pad 118. The user then returns the sanitary tray 119 and the reinforced toilet plunger 101 to their respective positions within the decorative canister 102.

In the first potential embodiment of the disclosure, the reinforced toilet plunger 101 was formed from a commercially available toilet plunger with an exterior screw thread 122 formed on the shaft 112 and a commercially available D Grip 113 with an interior screw thread 123 formed in the connector 125.

The shell 114, the door 115, and the sanitary tray 119 were formed from molded plastic. Suitable plastics include, but are not limited to, polyethylene or polycarbonate. The plurality of hinges 116, plurality of magnets 117, plunger clip 120, and door knob 121 are commercially available.

The following definitions are used in this disclosure:

Centerline: As used in this disclosure, the centerline is the axis of the cylinder. When two cylinders are centered on the same line this means that the cylinders of both cylinders share the same axis.

Exterior Screw Thread: An exterior screw thread is a ridge wrapped around the outer surface of a tube in the form of a helical structure that used to convert rotational movement into linear movement.

Interior screw Thread: An interior screw thread is a ridge wrapped around the inner surface of a tube in the form of a helical structure that used to convert rotational movement into linear movement The following definitions and directional references were used in this disclosure:

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A plunger comprising a reinforced toilet plunger and a decorative canister;

wherein the plunger is adapted for use with toilets;

wherein the plunger has a reinforced handle;

wherein the plunger has a threaded handle;

wherein the reinforced toilet plunger further comprises a force cup, a shaft, and a D Grip; wherein the force cup is a suction cup;

wherein the shaft is a cylindrical bar that is further defined with a fifth end and a sixth end;

wherein the fifth end of the shaft is connected to the force cup;

wherein the D Grip further comprises a hand grip, a seventh reinforced Y arm, an eighth reinforced Y arm, and a connector;

wherein the seventh reinforced Y arm and the eighth reinforced Y arm attach the connector to the hand grip;

wherein the connector is formed with an interior screw thread;

wherein the exterior screw thread located on the sixth end of the shaft is attached to the interior screw thread of the D Grip; wherein the interior screw thread is rotated onto the sixth end of the shaft, the shat is cut in order to form a tight connection between the D grip and the shaft.

2. The plunger according to claim 1 wherein the decorative canister further comprises a shell, a door, a plurality of hinges, a plurality of magnets, a removable absorbent pad, a sanitary tray, a plunger clip, and a door knob.

3. The plunger according to claim 2 wherein the shell is a cylindrically shaped hollow casing that is used to contain the reinforced toilet plunger;

wherein the of the shell are further defined as a top end and a bottom end;

wherein the bottom end is a flat surface that rests on the ground;

wherein the top end is the end of the shell that is distal from the bottom end.

4. The plunger according to claim 3 wherein the door is a solid closure that is used to block access to the interior of the shell through an aperture.

5. The plunger according to claim 4 wherein the door is mounted onto the shell using a plurality of hinges.

6. The plunger according to claim 5 wherein the door is held in position the closed position with a plurality of magnets.

7. The plunger according to claim 6 wherein the door knob is mounted on the door.

8. The plunger according to claim 7 wherein within the interior of the shell is placed the sanitary tray.

9. The plunger according to claim 8 wherein the sanitary tray is designed to receive the removable absorbent pad.

10. The plunger according to claim 9 wherein the sanitary tray is designed to be removed from the interior of the shell.

11. The plunger according to claim 10 wherein the removable absorbent pad is an absorbent material that is placed in the sanitary tray.

12. The plunger according to claim 11 wherein the plunger clip is a small U shaped clip that is attached to an eleventh shaft;

wherein the eleventh shaft is mounted in the interior surface of the shell so that the U shaped clip is centered over the centerline of the shell.

* * * * *